United States Patent [19]

Goodwin

[11] Patent Number: 4,774,386

[45] Date of Patent: Sep. 27, 1988

[54] SPANNING DEVICE

[76] Inventor: Dennis Goodwin, 2626 SW. 112th, Seattle, Wash. 98146

[21] Appl. No.: 397,481

[22] Filed: Jul. 12, 1982

[51] Int. Cl.[4] ..... B66C 23/60

[52] U.S. Cl. ..... 180/298; 248/671; 248/675; 254/4 R; 254/264; 254/325; 294/67.1; 403/385; D34/34

[58] Field of Search ..... 180/294, 291, 298, 54.1; 280/5 R, 87.1; 248/671, 675; 254/4 R, 325, 376, 264; 52/633; 403/385; 414/460, 461; D34/33-37; 294/67 R

[56] References Cited

U.S. PATENT DOCUMENTS

| | | | |
|---|---|---|---|
| 3,652,057 | 3/1972 | Brown | 254/264 |
| 4,030,705 | 6/1977 | Bontrager | 180/298 X |
| 4,355,832 | 10/1982 | Andersen | 294/67 R |

FOREIGN PATENT DOCUMENTS

| | | | |
|---|---|---|---|
| 231230 | 3/1925 | United Kingdom | 403/385 |

*Primary Examiner*—John J. Love
*Assistant Examiner*—Mitchell J. Hill
*Attorney, Agent, or Firm*—Thomas W. Secrest

[57] ABSTRACT

The spanning device is a tool designed to assist in the working on front wheel drive automobiles. These front wheel drive automobiles are, generally, small automobiles with transverse engines or engines whose crankshaft is, substantially, at a right angle to the longitudinal axis to the automobile. This spanning device is of assistance while the engine and/or transmission must be held aloft or either the engine or the transmission removed from the automobile. The spanning device has a three point resting position which can be positioned on the windshield cowl, the radiator frame and the fender attachment point. A main longitudinal rod and a transverse rod can be held in position by a clamping means or a coupling means. A lifting device may be applied on each rod and at any point on the rod. A draw bolt lift attachment can be used for lifting the engine and/or the transmission and/or the combination of the engine and transmission. As well, it is possible to use the draw bolt lifting device for lowering the engine and/or the transmission and/or the combination of the engine and transmission. The various components of the spanning device are adjustable and are locked by means of set screws and knobs so as to have a rigid structure.

20 Claims, 16 Drawing Sheets

SPANNING DEVICE

THE BACKGROUND OF THE INVENTION

This invention is directed to use with an automobile. However, the invention is not restricted to use with an automobile.

Prior to about 1978 or 1979, most automobiles had an engine in front of the passengers. There was a differential in back of the passengers and underneath the main body of the automobile. Also, there was a transmission connecting with the engine and with the differential. The transmission was underneath the main body of the automobile and, approximately, underneath the driver of the automobile. The crankshaft of the engine was longitudinally positioned with respect to the automobile. In other words, the crankshaft of the engine, the transmission and the driveline from the transmission to the differential was longitudinally positioned or ran lengthwise of the automobile. The crankshaft of the engine was at, approximately, a right angle to the axis between the front wheels. The differential was between the rear wheels of the automobile.

About 1978 or 1979 many of the automobiles manufactured in the United States had the engine and the transmission positioned, approximately, between the front wheels. The crankshaft of the engine was, approximately, parallel to the axis between the front wheels of the automobile or, at, approximately a right angle to the longitudinal axis of the automobile.

With the larger automobiles manufactured before about 1979, the engines in the longitudinal position in the automobiles were larger than the engines in the smaller automobiles manufactured after about 1978 and with the engines in the smaller automobiles being transverse to the longitudinal axis of the automobile.

With the larger automobile and the larger engines in the longitudinal position, the removal of the engine from the automobile was, generally, accomplished by a self-contained external lifting device. A self-contained external lifting device may be an A-frame, a hoist and chain on an overhead beam and a portable platform having a pulley and chain. Also, the transmission from the larger automobile was removed by lowering the transmission. However, in many automobiles the engine and the transmission could be removed as an integral unit from the automobile.

With the smaller automobile and withthe smaller engine and the engine having a crankshaft substantially parallel to the transverse axis of the automobile a self-contained external lifting device is not always necessary. In fact, the smaller engines in the automobiles can be lifted or lowered by means of a device positioned on the frame of the smaller automobile. This invention is an outgrowth of the smaller engine being in the transverse position to the longitudinal axis of the automobile.

A BRIEF DESCRIPTION OF THE INVENTION

With the smaller automobiles and the smaller engines, in a transverse position to the longitudinal axis of the automobile, the small engine and associated transmissions are, generally, between the front wheels of the smaller automobile. The engine and the transmission connect together so as to be integral.

From time to time it is necessary to rebuild or repair the engine or the transmission. The reader is to remember that the engine and/or the transmission in one of the smaller automobiles is, relatively, light in weight. When it is necessary to work on either the engine or the transmission, or both, it may be desireable to maintain one of these units in position in the automobile while working on the other. Another way of stating this is that it may be desirable to maintain the engine in place on the automobile while working on the transmission while either lowering or raising the transmission. Likewise, it may be desirable to maintain the transmission in place in the automobile while lowering the engine or raising the engine to remove the engine from the engine well of the automobile. Instead of using a self-contained external lifting device, which has to be stored in an out of the way position when not in use and which external device is generally bulky, I have invented the present invention. The present invention makes it possible to place on the frame of the automobile a suspension device for maintaining, lowering or raising the transmission or the engine, as the case may be, in the engine well of the automobile. The result is that there is a saving in time by the repair person and therefore a saving in money. Also, there is a saving in the frustration of the repair person performing the repairing of the automobile.

THE DRAWINGS

Figure 19:
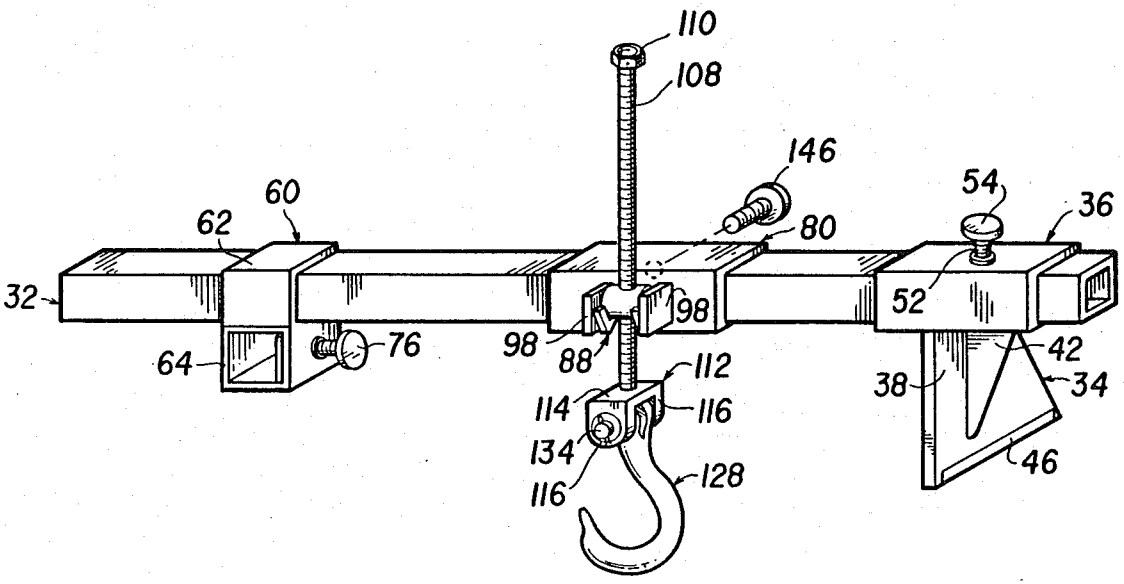
Figure 20:
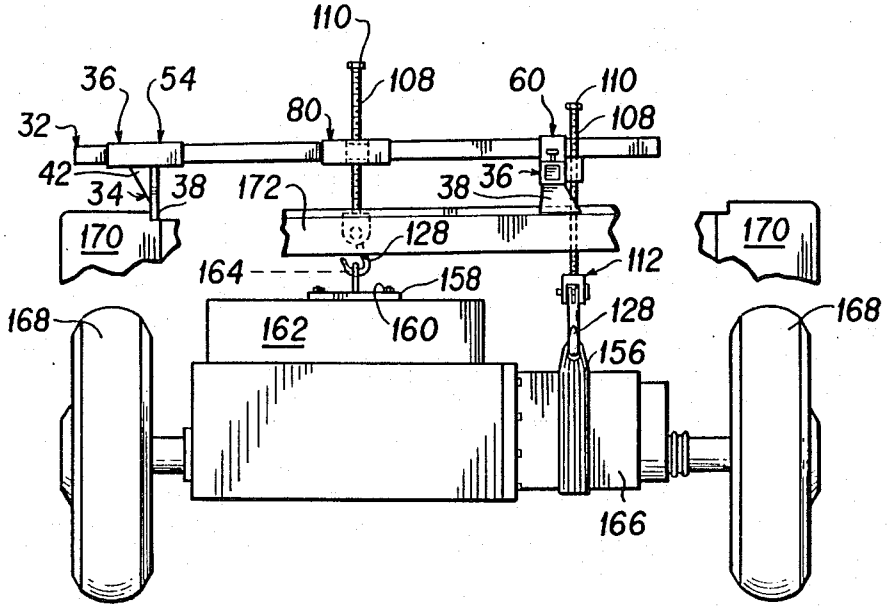

FIG. 19 is a perspective view looking at a rod with one moveable support on one end, the clamping means, the moveable collar with attached support brackets and means for raising and lowering a hook for positioning an engine or transmission in a desired location; and, FIG. 20 is a fragmentary front elevational view with part of the radiator removed to illustrate the spanning device connecting with the engine and the transmission.

THE SPECIFIC DESCRIPTION OF THE INVENTION

The spanning device is a tool designed to assist in the working on front wheel drive automobiles. These front wheel drive automobiles are, generally, small automobiles with transverse engines or engines whose crankshaft is, substantially, at a right angle to the longitudinal axis to the automobile. This spanning device is of assistance while the engine and/or transmission must be held aloft or either the engine or the transmission removed from the automobile. An operator of the spanning device, after attaching the device to the engine or the transmission, can hold the engine and/or transmission aloft in the engine well of the automobile, with no other support. This spanning device may also assist in raising or lowering any combination of the engine or transmission from its normal position to twelve inches upwardly to twelve inches downwardly.

The spanning device has a three point resting position which can be positioned on the windshield cowl, the radiator frame and the fender attachment point. Its legs can be of different heights in order that a thoroughly horizontal plane of the rod may be maintained while the device is being used. The main rod may run longitudinally from the windshield cowl to the radiator frame. The main rod can be intersected by a shorter tube which is at, approximately, a ninety degree angle to the main rod. The main longitudinal rod and the transverse rod can be held in position by a clamping means or a coupling means.

A lifting device may be applied on each rod and at any point on the rod. A draw bolt lift attachment can be used for lifting the engine and/or the transmission and/or the combination of the engine and transmission. As well, it is possible to use the draw bolt lifting device for lowering the engine and/or the transmission and/or the combination of the engine and transmission. The various components of the spanning device are adjustable and are locked by means of set screws and knobs so as to have a rigid structure.

There is a suspension unit. The suspension unit can move on an appropriate rod. There is a locking device for the suspension unit on the rod. When the suspension unit is at the desired location the blocking device can be activated to hold the suspension unit onto the rod. The suspension unit can position a lifting device or a lowering device for lifting or lowering, or maintaining, an engine and/or transmission.

The suspension unit is moveable on the rod. Also, there is a clamping means which is moveable with respect to the rod. In fact, the clamping means is moveable with respect to the two rods at a right angle to each other. There is a collar between the suspension unit and the rod and also the clamping means and the rods so that the suspension unit and the clamping means can assume a comfortable position with respect to the rod. Then, the suspension unit and the clamping means can be definitely positioned onto the appropriate rod. This arrangement of a tolerance with respect to the suspension unit and the clamping means with respect to the rod allows the rods to adjust to any reasonable irregularities in alignment.

In the drawings, it is seen that there is a first rod 30 and a second rod 32. Rods 30 and 32 are, substantially, at right angles to each other. The first rod 30 may be substantially transverse to the longitudinal axis of the automobile and the second rod 32 may be substantially parallel to the longitudinal axis of the automobile. Or, the first rod 30 may be substantially parallel to the longitudinal axis of the automobile and the second rod 32 may be substantially transverse to the longitudinal axis of the automobile.

In the drawings it is seen that near each end of the first rod 30 there is a moveable support 34. In essence the moveable support 34 is a leg for supporting the rod 30.

The moveable support 34 comprises a housing 36 for fitting over the rod 30 or 32. The support 34 comprises a leg 38 welded at 40 to the housing 36.

It is seen that there is a brace 42 which connects at the leg 38 by means of weld 44 and which connects with the housing 36 by means of weld 40.

On the outer edge of moveable support 34 there is a protective sheath 46. The protective sheath 46 can be of a suitable plastic.

On that side of the housing 36, opposite to the side to which leg 38 is welded, there is a nut 48. In that side adjacent to the nut 48 there is a passageway 50. A threaded rod 52 is screwed into the nut 48. On the outer end of the rod 52 there is a knob 54. On the inner surface of the housing 36 and adjacent to the nut 48 there is a bearing plate 56. The nut 48 is welded to the housing 36 by means of weld 58.

The threaded rod can be rotated so as to move the bearing plate 56 away from the rod 30 or a rod 32. Then the housing 36 can be moved on the rod 30 or 32 to a desired location. The threaded rod can be rotated so that its inner end bears against the bearing plate 56. The bearing plate 56 is forced against the rod 30 or 32 to definitely position the moveable support 34 with respect to the appropriate rod.

In the drawings it is seen that with the rod 32 there is only one moveable support 34. With the arrangement of the rod 30 having two moveable supports and the rod 32 having one moveable support, there is no need for two moveable supports 34 in the rod 32.

In the drawings it is seen that the rod 30 and also the rod 32 are square tubes. Also, the housing 36 is a square tube. The internal dimensions of the housing 36 are greater than the external dimension of the rod 30 or the rod 32. This allows some movement of the housing 36 with respect to the rod 30 or with respect to the rod 32 so that there is a tolerance to irregularities in the supporting surface for the moveable support 34. It is conceivable that the rod 30 and the rod 32 can be solid rod instead of a tube. However, I consider that with a solid rod that the weight would be a disadvantage and also that there would be a waste of metal. A tube is satisfactory for the rod 30 and also satisfactory for the rod 32.

Figure 14:
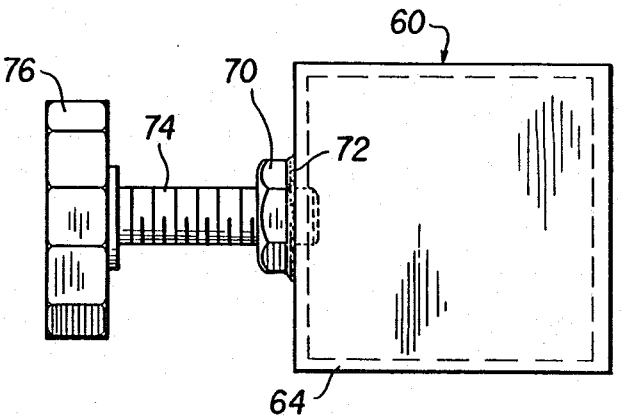
FIG. 14 is a top or bottom plan view of the clamping means.
Figure 13:
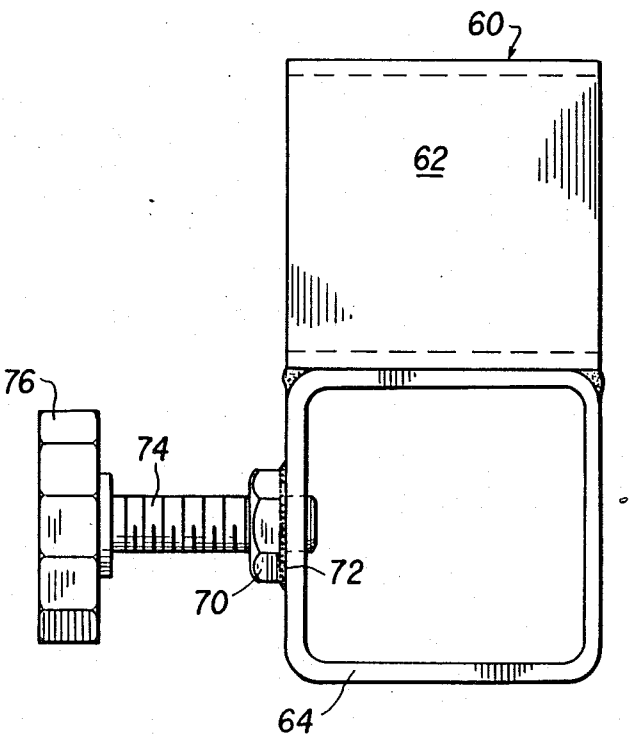
FIG. 13 is a side elevational view of the clamping means with two collars at right angles to each other for movement with respect to the support rod.
Figure 12:
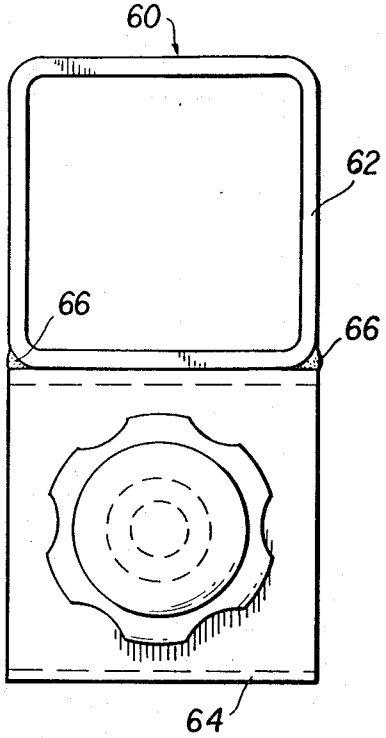
FIG. 12 is a front elevational view of a clamping means showing two support collars at right angles to each other for movement with respect to respective rods.
Figure 16:
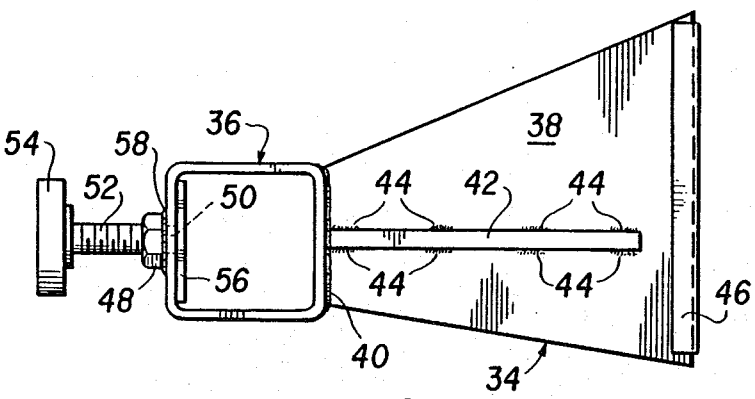
FIG. 16 is a front elevational view of a moveable support for connecting with one of the rods.
Figure 17:
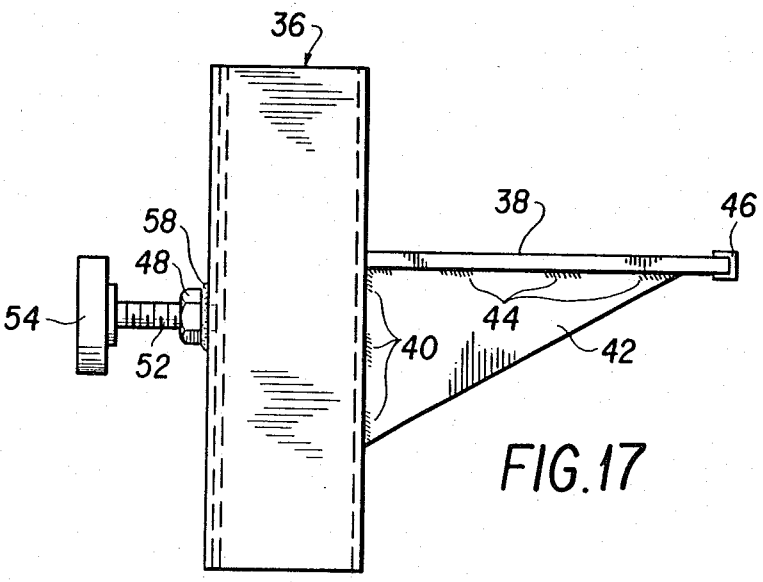
FIG. 17 is a side elevational view of the moveable support for connecting with one of the rods.
Figure 15:
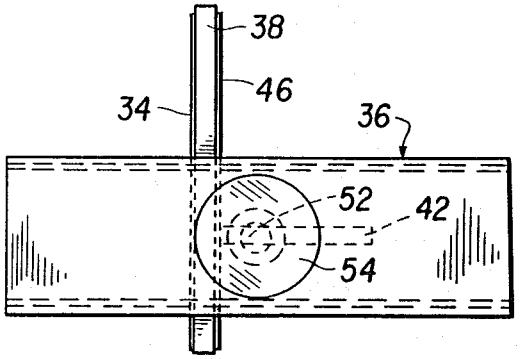
FIG. 15 is a top plan view of an adjustable leg for connecting with one of the rods.
Figure 18:
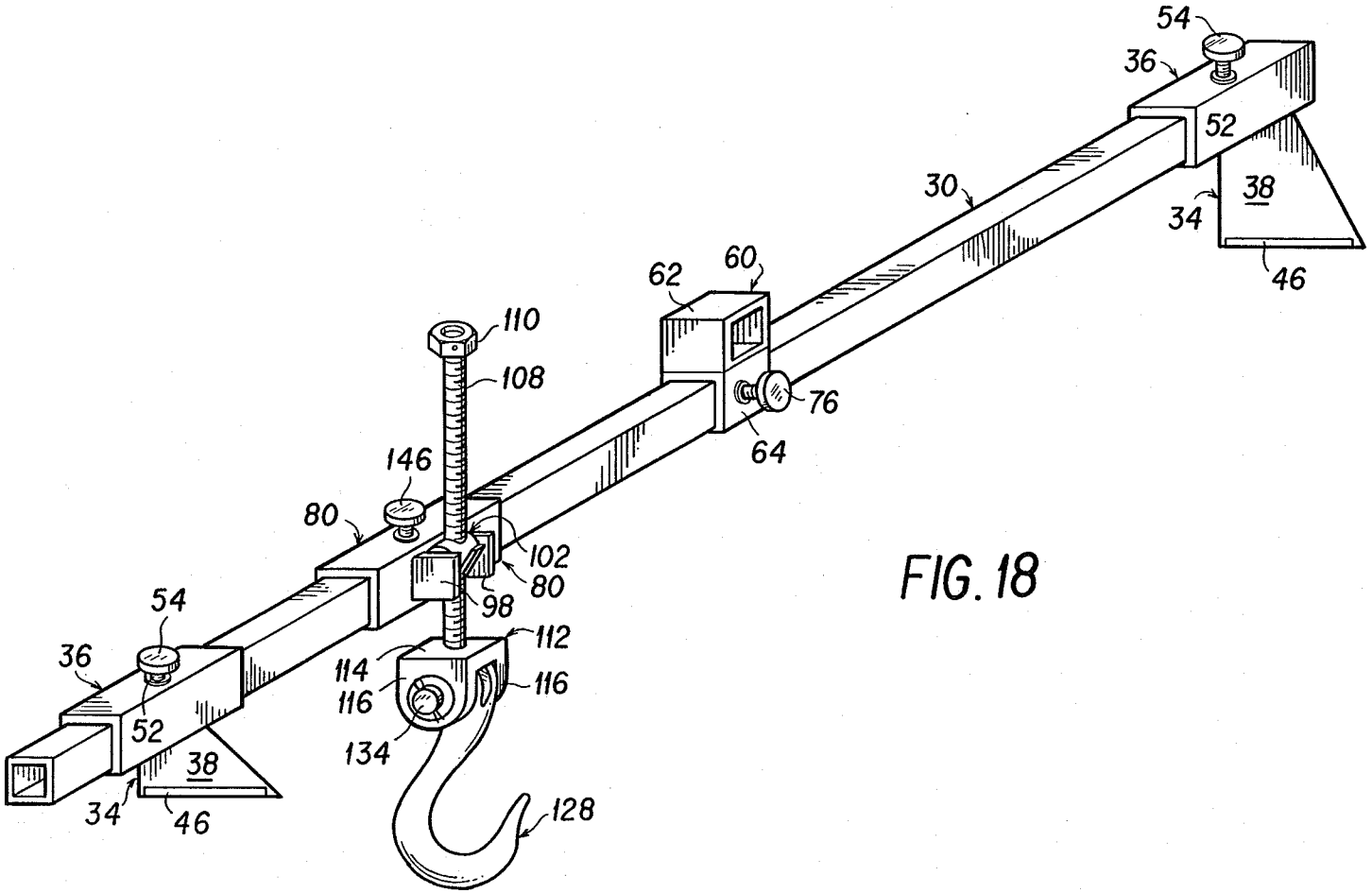
FIG. 18 is a perspective view of one rod showing two moveable supports, one near each end, for supporting the rod, a moveable collar with the support bracket and the lifting means connecting with the support bracket for raising, lowering and holding an engine or transmission into a desired position and location.

In FIGS. 12, 13 and 14 it is seen that there is a clamping means 60. The clamping means 60 comprises a first housing 62 and a second housing 64. The housing 62 is a square tube and the housing 64 is a square tube. The passageway in the housing 62 is at a right angle to the passageway in the housing 64. A weld 66 connects the housing 62 with the housing 64.

In a side wall of the housing 64 there is a passageway 68. on the outside of the side wall having the passageway 68 there is a nut 70. A weld 72 joins the nut 70 with the side wall of the housing 64. There is a threaded rod 74 screwed into the nut 74 which passes through the passageway 68. A knob 76 is on the outer end of the threaded rod 74.

Figure 1:
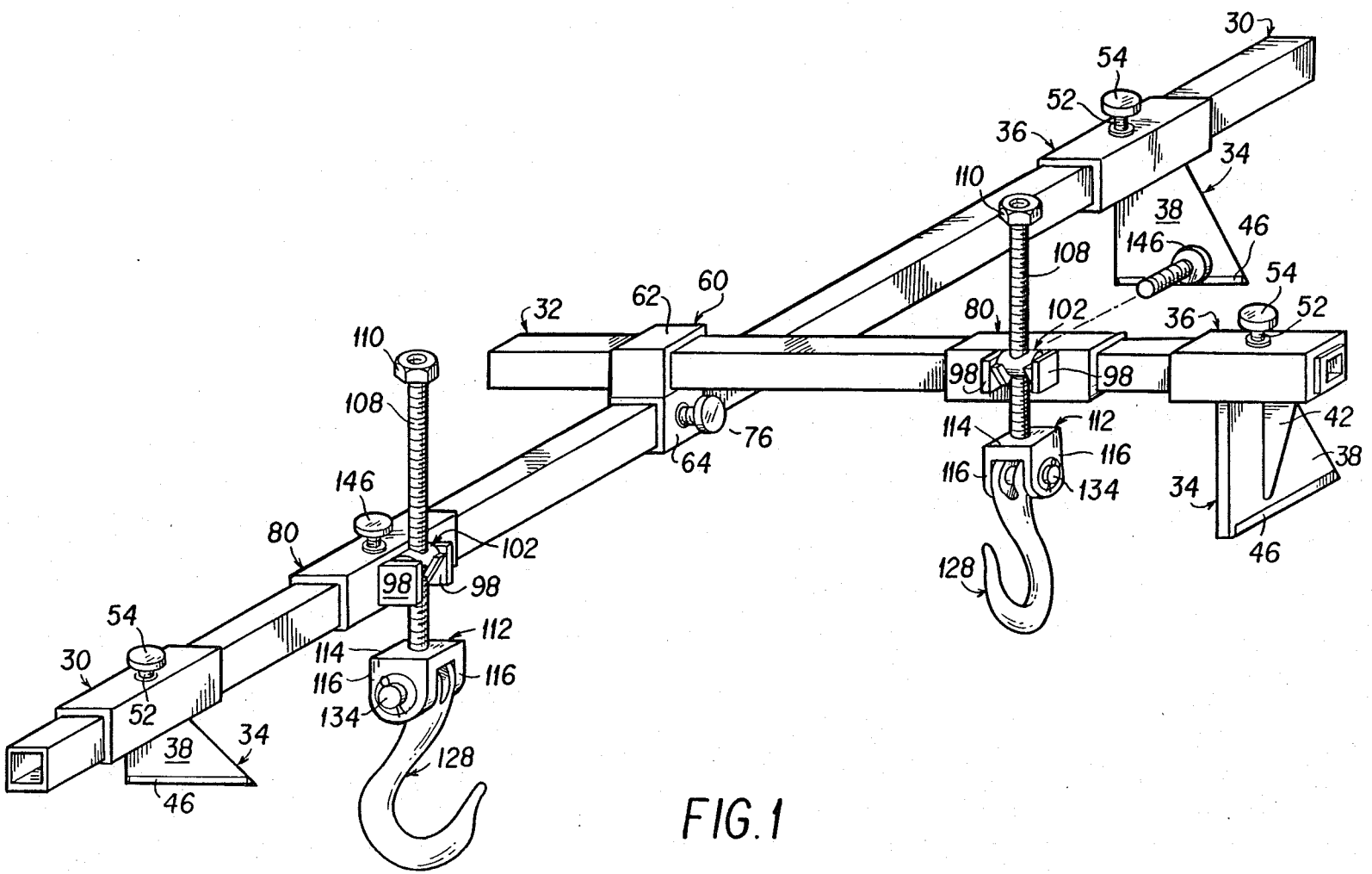
FIG. 1 is a perspective view of the spanning device illustrating two rods at right angles to each other and associated support apparatus.
Figure 2:
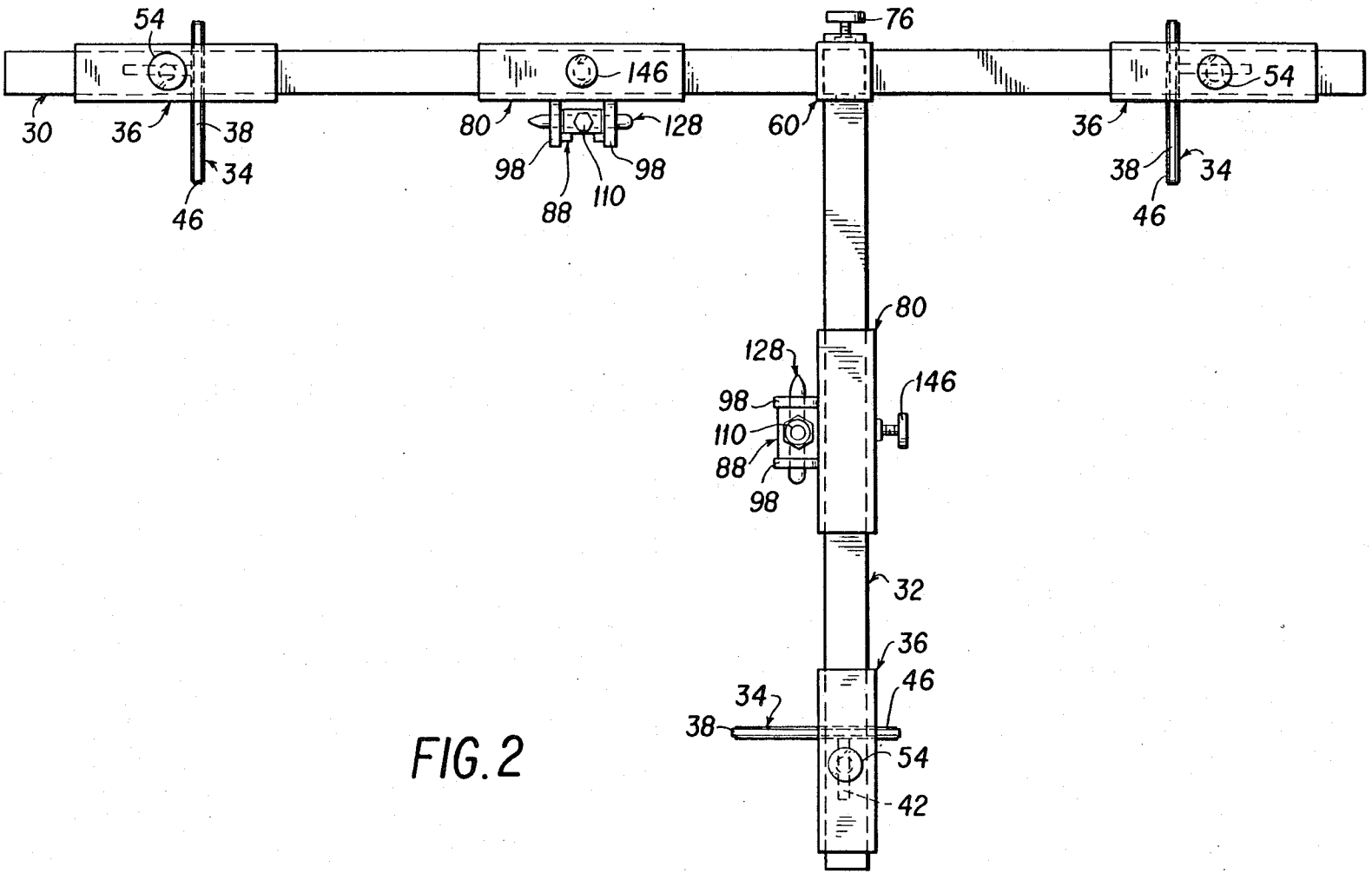
FIG. 2 is a top plan view of the spanning device and illustrates the two rods at right angles to each other and the support apparatus.
Figure 3:
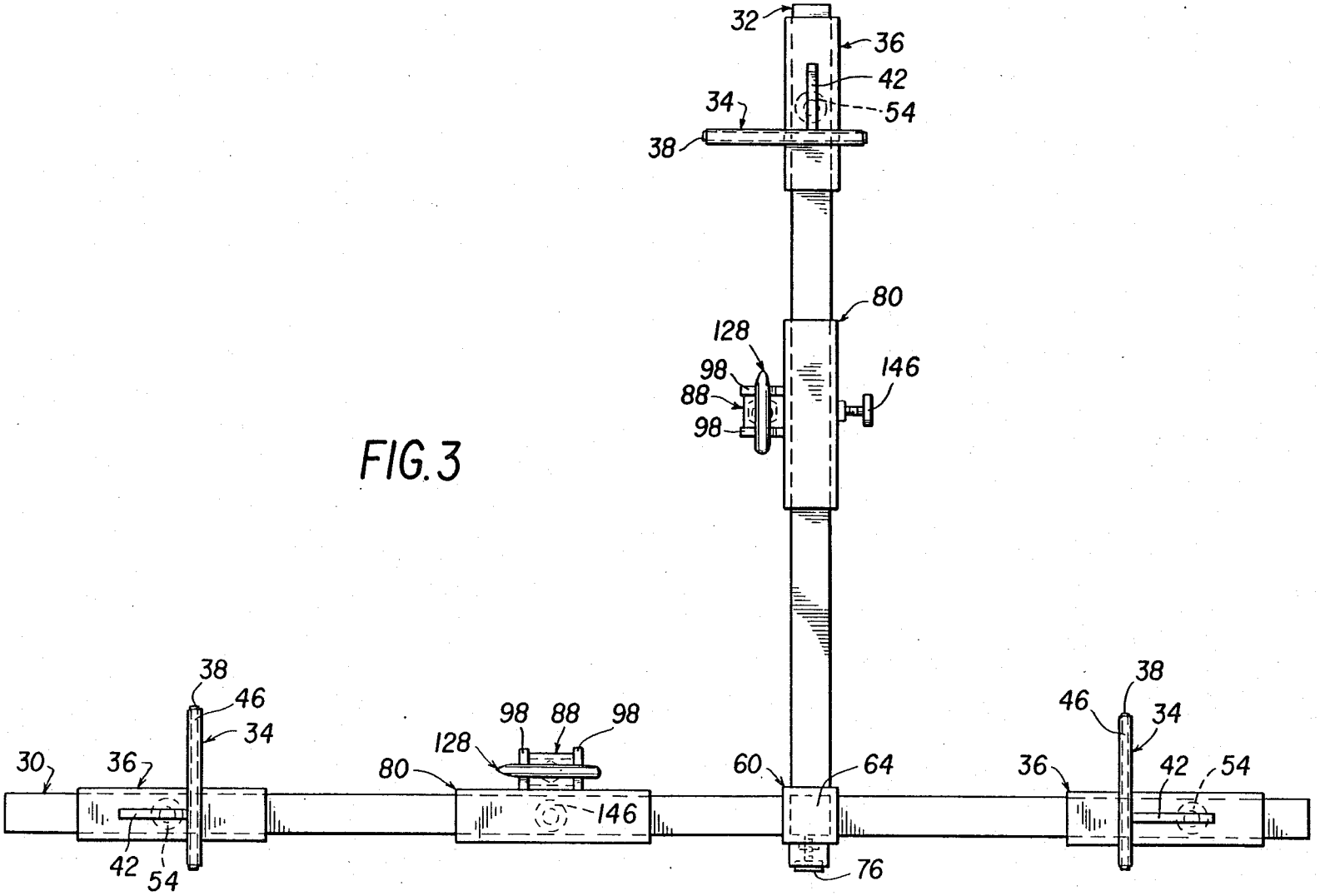
FIG. 3 is a bottom plan view of the spanning device and illustrates the two rods at right angles and associated support apparatus
Figure 4:
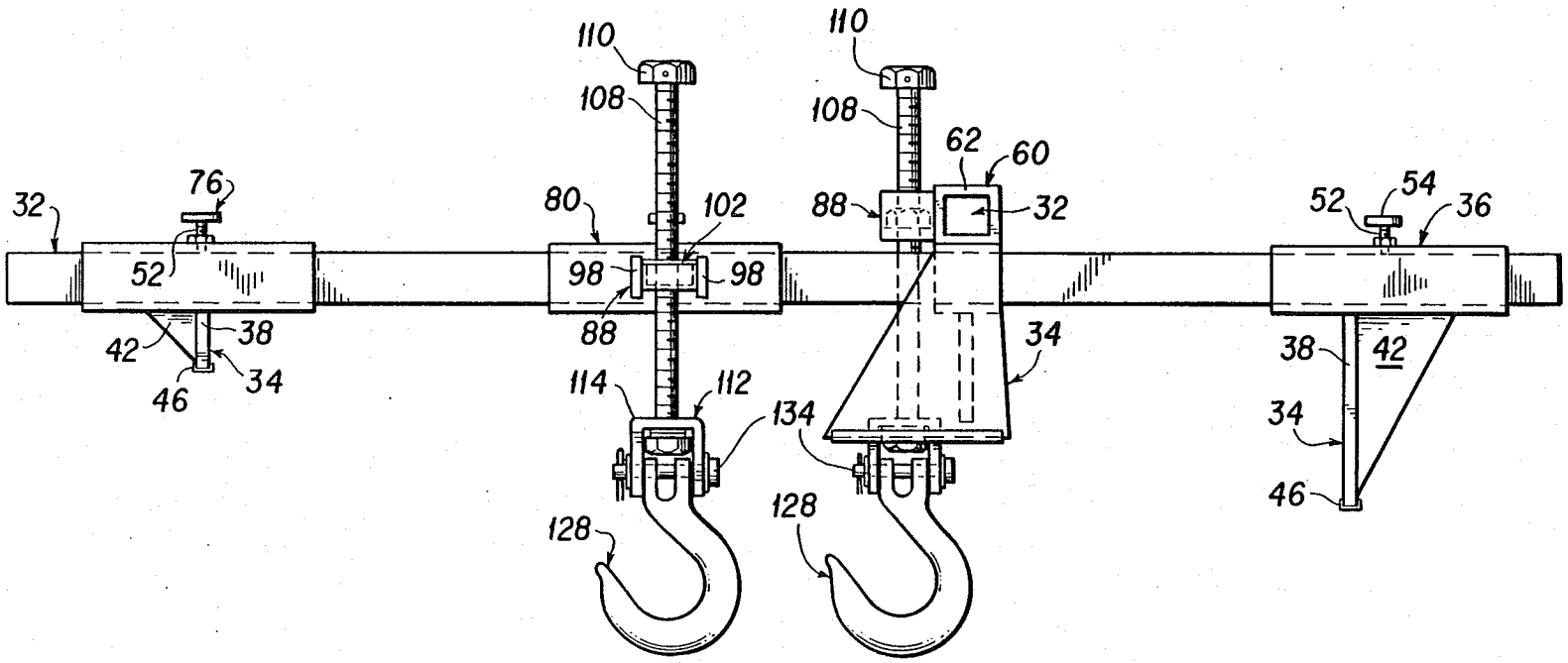
FIG. 4 is an end elevational view of a longitudinal rod and a side elevational view of a transverse rod at right angles to each other and associated support and apparatus.
Figure 5:
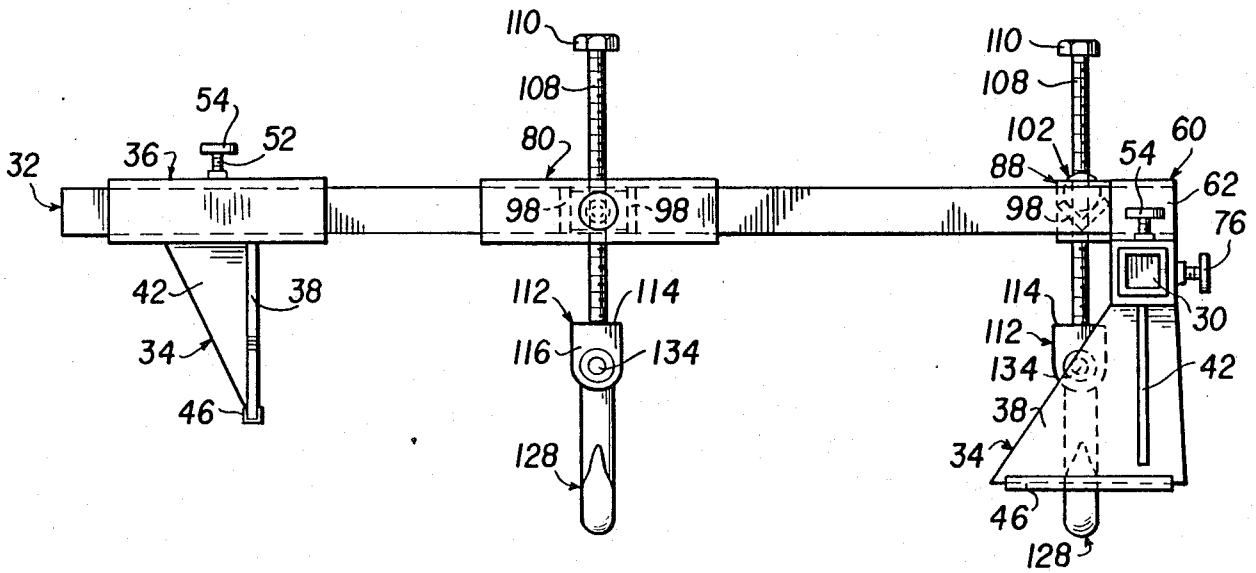
FIG. 5 is an end elevational view of the transverse rod and a side elevational view of the longitudinal rod at right angles to each other and associated apparatus.

In FIG. 1 it is seen that the clamping means 60 is positioned on the first rod 30. The first rod 30 passes through the housing 64. The second rod 32 passes through the housing 62.

The clamping means 60 can be definitely positioned on the first rod 30 by rotating the threaded rod 74 to have the inner end of the threaded rod 74 bear against the outer surface of the first rod 30. Then, the second rod 32 can be moved into the first housing 62.

Figure 11:
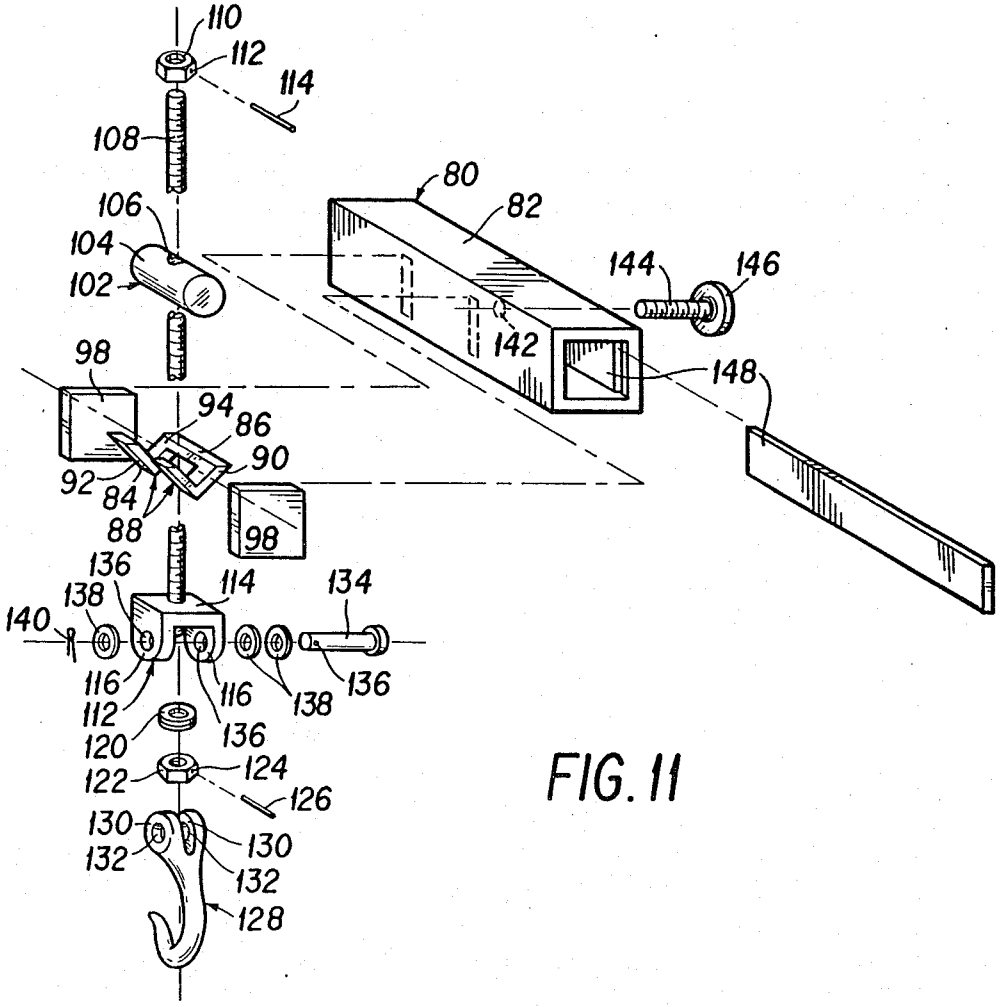
FIG. 11 is an exploded perspective view of the moveable collar, the support bracket, the moveable positioning means, the threaded rod, clevis and hook.

In FIG. 11 there is illustrated a suspension unit 80 comprising a moveable collar 82.

There is a support bracket 84 having a base 86. It is seen that there connects with the base 86 two spaced apart legs 88. Next to the base 86 there is a downward member 90 and then the downward member bends upwardly into an upward member 92. Each leg comprises the downward member 90 and the upward member 92. The downward member 90 and the upward member 92 provide a cradle 94.

The spaced-apart legs 88 define a recess 96.

On the outer surface of each leg 88 there is a side plate 98. The base 86 and the side plate 98 are welded at 100 to the outer surface of the collar 82 or welded to the outer surface of the square tube comprising the collar 82.

In FIG. 11 it is seen that there is a moveable positioning means 102 or an adjustable attaching means 102. In fact the moveable positioning means 102 or an adjustable attaching means 102 appears to be a right circular cylinder 104. In the central part of 104 there is a lateral threaded passageway 106. A threaded rod 108 is screwed into the passageway 106. A nut 110 is screwed onto the upper end of the threaded rod 108. In the side of the nut 110 there is a passageway 112. A pin 114 can be positioned in the passageway 112 to lock the nut 110 onto the threaded rod 108.

On the lower end of the threaded rod 108 there is a clevis 112. The clevis 112 has a base 114 and two spaced-apart depending legs 116. In each of the legs 116 there is a passageway 118. The passageways 118 in the legs 116 are aligned.

There is positioned around the lower end of the threaded rod 108, and underneath the base 114, bearing 120. A nut 122 is screwed onto the lower end of the threaded rod 108 to definitely position the bearing 120 and the threaded rod 108 with respect to the clevis 112. In the nut 122 there is a lateral passageway 124. A pin 126 is positioned in the passageway 124 and bears against the rod 108 to definitely position the nut, the washers and the clevis with respect to the rod 108.

There is a hook 128 having two spaced apart legs 130. In each of the legs 130 is a passageway 132. The passageways 132 are aligned. The hook 128 is positioned in the clevis 112 with the passageways 132 aligned with the passageways 118. Then, a pin 134 can be pushed through the passageway 118, the two passageways 132 and the passageway 118 and the other leg of the clevis 112. In the outer end of the pin 134 there is a passageway 136. When appropriate, the washers 138 may be placed with respect to the legs 116 of the clevis 112 and to the pin 134. Then, with the hook 128 positioned with respect to the clevis 112 by the pin 134 a cotter key 140 can be positioned in the passageway 136 to keep the pin 134 in position.

The suspension unit 80 can be moved on the rod 30 or on the rod 32. The interior dimensions of the suspension unit 80 are larger than the exterior dimension units of the rod 30 or the rod 32. It is seen that the collar 82 is square so as to fit with the exterior surfaces of the rod 30 or the rod 32.

On the side wall of the collar 82 there is a threaded passageway 142. The threaded passageway 142 is in that side wall opposite the side wall on which the support bracket 84 is positioned. There is screwed into the threaded passageway 142 a threaded rod 144. On the outer end of the threaded rod 144 there is a knob 146.

There is positioned between the inner wall of the collar 82 and the exterior wall of the rod 30 or 32 a bearing plate 148. When the suspension unit 80 is in the desired position on the rod 30 or on the rod 32, the threaded rod 144 can be rotated so that the inner end bears against the bearing plate 148 to bear against the rod 30 or the rod 32. This definitely positions the suspension unit 80 with respect to the rod 30 and the rod 32.

Figure 6:
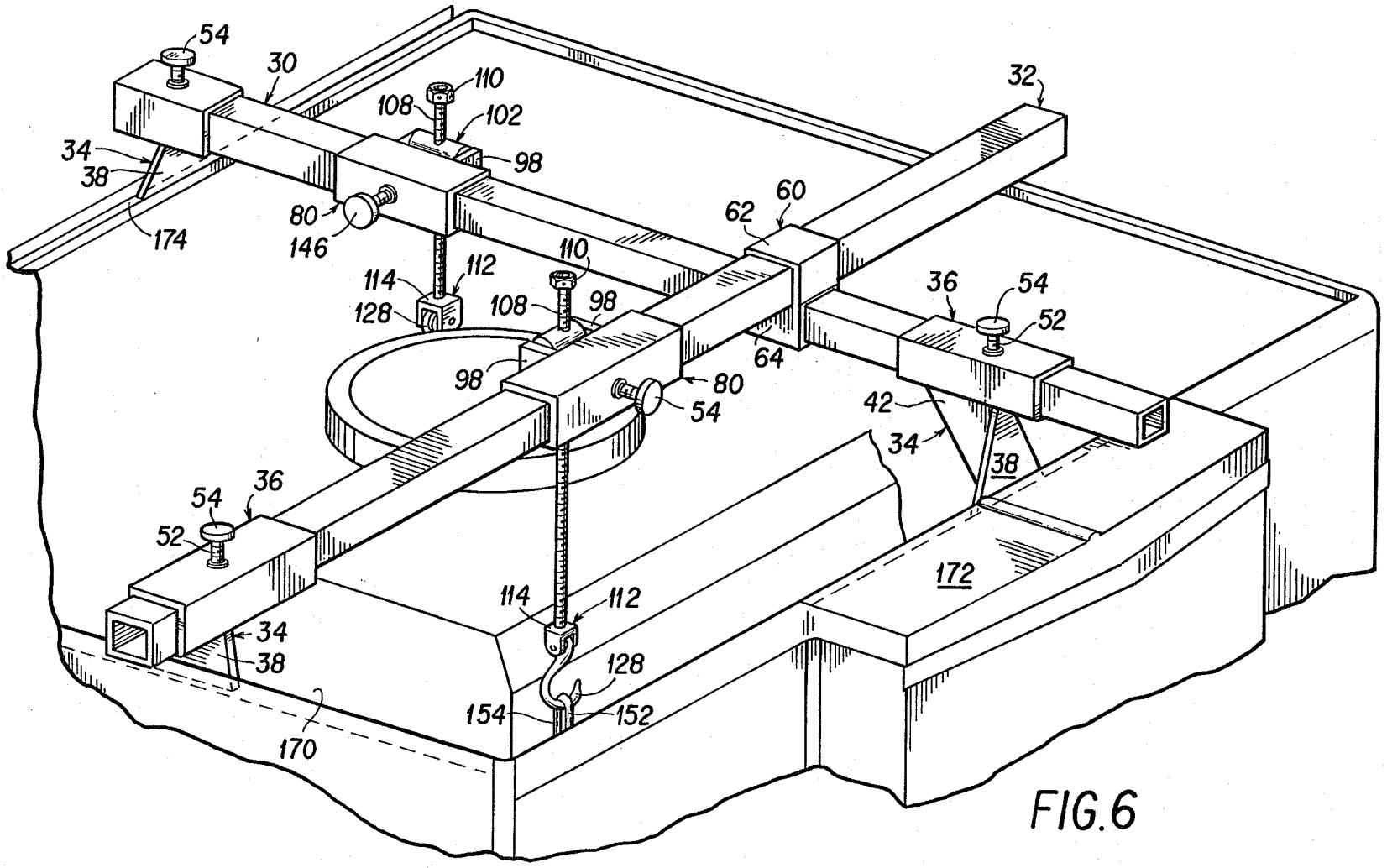
FIG. 6 is a perspective view illustrating the engine well of a small automobile with an engine in a transverse relationship to the longitudinal axis of the small automobile or, generally, positioned between the front wheels of the small automobile and with the two support rods, at right angles to each other, for attachment to the engine, illustrated in block form.

In FIG. 6 there is a schematic illustration of a cable 152. There is a loop 154 in the cable. A hook 128 is positioned in the loop 154. With the spanning device and the threaded rods, hook 128 and cable 152 it is possible to support an engine or a transmission. The cable 152 can pass underneath the engine or transmission and connect with another hook 128 positioned on the other side of the engine.

Figure 7:
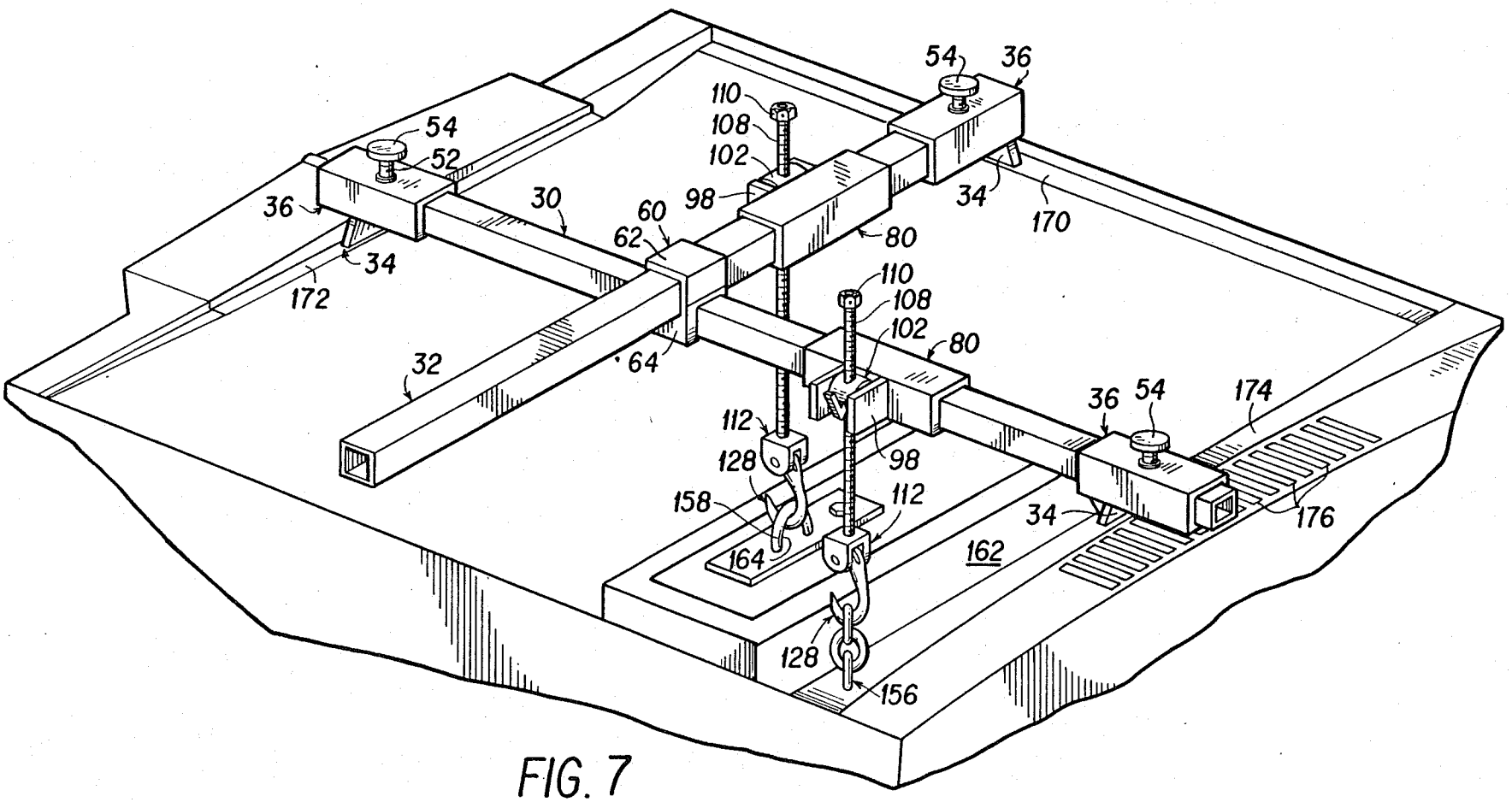
FIG. 7 is a perspective view looking down on the engine well of an automobile and illustrates the two rods at a right angle to each other and with the supporting hooks for supporting the transmission and/or engine.
Figure 8:
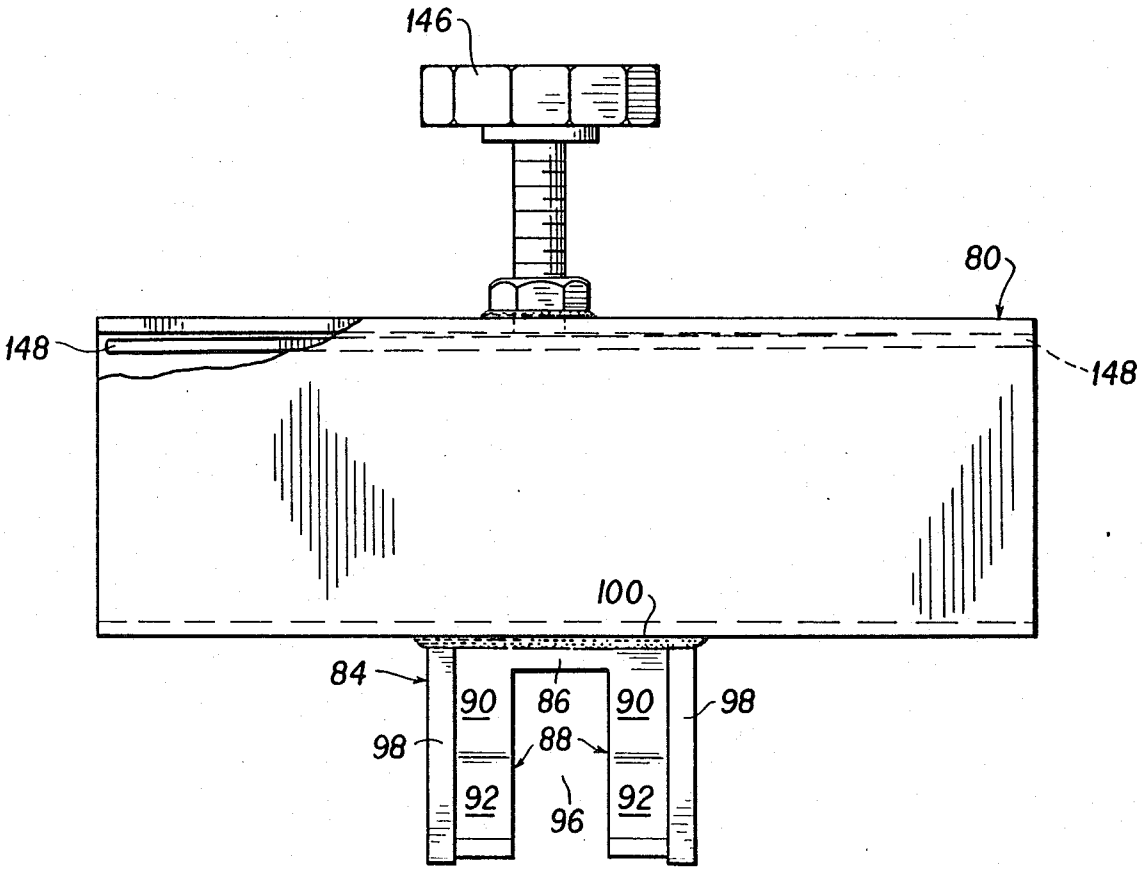
FIG. 8 is a plan view of a moveable collar for moving on one of the rods and a plan view of the attached support brackets.
Figure 9:
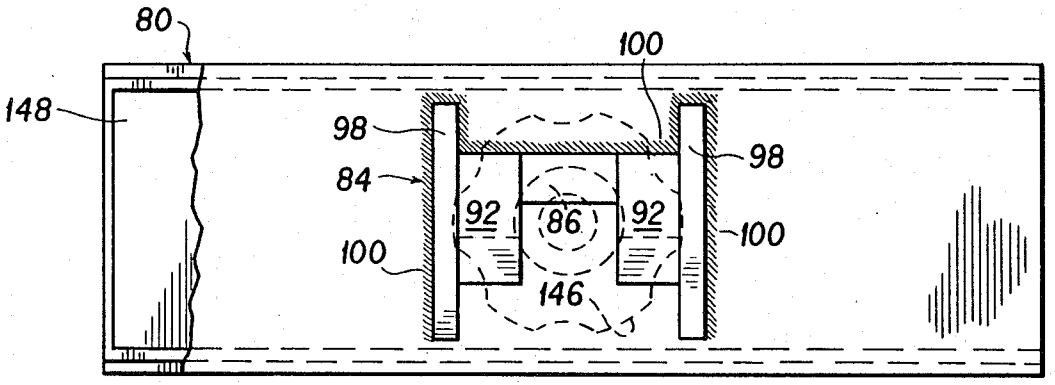
FIG. 9 is a front elevational view of the moveable collar for moving on one of the rods and a view of the attached support brackets.
Figure 10:
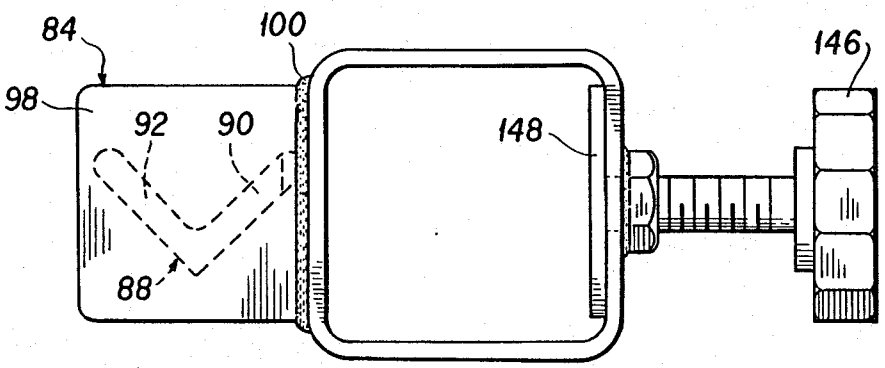
FIG. 10 is an end elevational view of the moveable collar for moving on one of the support rods and a view of the attached support brackets.

In FIG. 7 there is illustrated a chain 156. The hook 128 connects with the chain 156.

A bracket 158 is attached by means of a pin or bolt 160 to an engine block 162. The bracket 158 has an eye 164. A hook 128 is through the eye 164 for lowering or maintaining the engine block in a set position. Also, the hook 128 connecting with the chain 156 can maintain the engine in a fixed position.

In FIG. 20, a fragmentary elevational view of the engine and transmission in the automobile well, there is illustrated a hook 128 connecting with the bracket 158 on an engine 162. Also, there is illustrated a hook 128 connecting with a belt 156 supporting a transmission 166. The engine 162 can be maintained in a fixed position or raised or lowered. Likewise, thetransmission 166 can be maintained in a fixed position or raised or lowered.

A small engine 162 or a small transmission 166 can be held in position by the bolts and hook 128. The bracket 158 may be standard equipment on the engine or transmission and can be added to the engine or transmission if necessary.

From the foregoing it is seen that I have provided a manual lift mechanism comprising one or two rods. The rods may be in a supportive relationship with each other. There is an attaching means for the bolts to the rod. On the end of the bolts there can be a clevis and a hook. It is possible to connect the hook with an engine and/or transmission and maintain the same at a fixed position or raise the same or lower the same twelve inches.

Further, this spanning device is not in a dangerous position on the automobile. The spanning device can be supported on the frame of the automobile near the front fenders and also can be supported on the radiator and cowling near the windshield.

I have provided a square tube for the rod. The external dimensions of the square tube are less than the internal dimensions of the clamping means, the supporting means and the moveable support. Therefore, it is possible for the square tube and the clamping means, moveable support to move with respect to each other and to adjust for reasonable irregularities betweeen the spanning device and the automobile.

The moveable support is not adjustable. The length is a fixed length. Therefore, it is necessary to use moveable supports in different sizes for different automobiles. I prefer to have a moveable support which is integral and cannot be adjusted as I think it is of a more inherent stronger construction.

The components of my invention are inexpensive. There is used a square tube, an adjustable moveable positioning means, a bolt and a hook. It is possible by rotating the bolt to rotate the hook and to change the elevation of the engine and/or transmission. I have mentioned that the tube is a square tube. It is possible to use another type of tube such as a hexagonal tube or another tube. A readily commercially available tube is a square tube.

The spanning device is light in weight. The tube is light in weight. Again, it is possible to use a solid rod. However, a solid rod is heavy in weight and has more strength than really is required.

It is seen that I have provided two rods at a right angle. There are three moveable supports for the two rods. The three moveable supports determine the plane.

The spanning device can be used in places other than an automobile. For example, the spanning device can be used for working on the engine and transmission in a boat. Another place for the use of the spanning device is with an engine and pump combination. A further use of a spanning device is with an engine and electric generator combination. The spanning device can be used for holding the engine, the associated transmission or associated pump or associated generator.

A patent search was made prior to preparing the patent application. The patent search brought forth an interesting patent to Bontrager. From the patent to Bontrager, the references cited against Bontrager were ordered and revealed some interesting facts. The patents known to me are as follows:

| | |
|---|---|
| Bontrager | 4,030,705 |
| Valle | 1,325,816 |

-continued

| | |
|---|---|
| Dyer | 3,142,463 |
| Steinmetz | 1,316,200 |
| Mayer et al | 1,242,712 |
| Bartholomew | 2,433,822 |
| Buehring | 2,772,010 |
| Pilot | 3,001,763 |
| Brown | 3,652,057 |
| Hasstedt | 3,794,296 |
| Gonzales | 3,831,791 |

I consider that my invention distinguishes over Bontrager who shows a complicated cable 88 and a hydraulic cylinder 80. Bontrager is used with an automobile having the crankshaft substantially parallel to the longitudinal axis of the automobile. Bontrager does not use a simple device such as a bolt and a hook. Bontrager uses a more complicated device, adjustable legs. I consider that my simple bolt and hook arrangement distinguishes over Bontrager. The patent to Mayer et al shows lever arm 1. There is attached to the lever arm 1 a lifting rod 4. The length of the lifting rod 4 is a fixed length and the length is not adjustable. On the block of the automobile engine there is an eye 6. A hook 8 on the end of the lifting rod 4 can be positioned on the eye 6 on the block. It is to be noted that one end of the lever arm is near the windshield cowling. This end is relatively fixed as it is free to rotate around the pin. The other end of the lever arm is free to rotated and can rest at the radiator cowling. It is possible to attach the hook 8 on the lifting rod 4 to the eye 6 and the block. Then the free end of the lever arm can be rotated around that end of the lever arm which is near the windshield cowling. This can be used to elevate the engine in the engine well. It is to be noted that the lever arm of Mayer is not fixed when the motor is being raised. The lever arm 1 is being rotated and moved when raising the motor. Again, the lifting rod 4 is of a fixed length no matter what position the lever arm is. There is no provision for providing the lifting rod 4 of a variable length.

The reference Brown is interesting from the standpoint of working on motors. However, the reference Brown is for use with rear mounted motors and not for use with motors mounted in front of the driver of the automobile. It is difficult to see how Brown could be used with the motors mounted on the front of the automobile.

In FIG. 20 it is seen that the transmission is connected to the front wheels 168 in a driving relationship. The automobile has fenders 170 and cowling 172 adjacent to the radiator. The spanning device is supported on the fenders 170 and the cowling 172.

In FIGS. 6 and 7 the spanning device is supported on the fender 170, the cowling 172 and cowling 174 near the windshield and near the air vents 176 in front of the windshield.

What I claim is:

1. An apparatus for supporting an object, said apparatus comprising:

a. a first rod having a first end and a second end;

b. a first movable support positioned on said first rod;

c. a second movable support positioned on said first rod;

d. each of said supports having a leg;

e. said first rod and said movable supports being capable of moving with respect to each other;

f. a suspension unit;

g. said suspension unit connecting with said first rod;

h. a support cradle connecting with said suspension unit;
i. a movable positioning means connecting with said support cradle;
j. said movable positioning means being capable of connecting with said object;
k. said movable positioning means being capable of being moved, substantially, at a right angle with respect to said cradle and said first rod;
l. said movable positioning means being rotatable in said support cradle;
m. said movable positioning means comprising a positioning means being supported by said supporting cradle;
n. said positioning means comprising a cylinder having a tapped passageway;
o. a threaded rod being in said tapped passageway;
p. said means to definitely position said suspension unit on said first rod being a clamping means;
q. said threaded rod being capable of moving in said tapped passageway to move said movable positioning means and said object; and,
r. said cylinder being rotatable in said support cradle.

2. An apparatus for supporting an object, said apparatus comprising:
a. a first rod having a first end and a second end:
b. a first movable support positioned on said first rod;
c. a second movable support positioned on said first rod;
d. each of said supports having a leg;
e. said first rod and said movable supports being capable of moving with respect to each other;
f. a suspension unit;
g. said suspension unit connecting with said first rod;
h. a support cradle connecting with said suspension unit;
i. a movable positioning means connecting with said support cradle;
j. said movable positioning means being capable of connecting with said object;
k. said movable positioning means being capable of being moved, substantially, at a right angle, with respect to said support cradle and said first rod;
l. said movable positioning means being rotatable in said support cradle;
m. a clamping means operatively connecting with said first arm;
n. a second rod;
o. said second rod operatively connecting with said clamping means; and,
p. a third movable support on said second rod.

3. An apparatus for supporting an object according to claim 2 and comprising:
p. said first rod and said second rod being at, substantially, a right angle.

4. An apparatus for supporting an object according to claim 3 and comprising:
q. said first rod having a plurality of first sides;
r. said first movable support having a plurality of second sides;
s. said first sides and said second sides being juxtapositioned, to have juxtapositioned sides, to guide the movement of said first rod and said first movable support with respect to each other;
t. said second movable support having a plurality of third sides;
u. said first sides and said third sides being juxtapositioned, to have juxtapositioned sides, to guide the movement of said first rod and said second movable support with respect to each other;
v. said second rod having a plurality of fourth sides;
w. said clamping means having a plurality of fifth sides;
x. said first sides and said fifth sides being juxtapositioned, to have juxtapositioned sides, to guide the movement of said first rod and said clamping means with respect to each other;
y. said clamping means having a plurality of sixth sides;
z. said fourth side and said sixth sides being juxtapositioned to guide the movement of said second rod and said clamping means with respect to each other;
aa. said third movable support having a plurality of seventh sides; and,
bb. said fourth side and said seventh sides being juxtapositioned, to have juxtapositioned sides, to guide the movement of said second rod and said third movable support with respect to each other.

5. An apparatus for supporting an object, said apparatus comprising:
a. a first rod having a first end and a second end;
b. a first movable support positioned on said first rod;
c. a second movable support positioned on said first rod;
d. each of said supports having a leg;
e. said first rod and said movable supports being capable of moving with respect to each other;
f. a suspension unit;
g. said suspension unit connecting with said first rod;
h. a support cradle connecting with said suspension unit;
i. movable position means connecting said support cradle;
j. said movable positioning means being capable of connecting with said object;
k. said movable positioning means being capable of being moved, substantially, at a right angle with respect to said cradle and said first rod;
l. said movable positioning means being rotatable in said support cradle;
m. a clamping means operatively connecting with said first arm;
n. a second rod;
o. said second rod operatively connected with said clamping means;
p. a third movable support on said second rod;
q. a second suspension unit on said second rod;
r. said suspension unit connecting with said second rod;
s. a second support cradle connecting with said suspension unit;
t. a second adjustable attaching means connecting with said second support cradle;
u. said second adjustable attaching means being capable of connecting with said object; and,
v. said second adjustable attaching means being capable of being moved with respect to said second support cradle and said second rod.

6. A combination of an automobile having an object such as an engine and a transmission, and an apparatus for supporting said object;
a. said apparatus comprising a first rod having a first end and a second end;
b. a first movable support positioned on said first rod;

c. a second movable support positioned on said first rod;
d. each of said supports having a leg;
e. said first rod and said movable supports being capable of moving with respect to each other;
f. a suspension unit;
g. said suspension unit connecting with said first rod;
h. a support cradle connecting with said suspension unit;
i. a movable positioning means connecting with said support cradle;
j. said movable positioning means being capable of connecting with said object;
k. said movable positioning means being capable of being moved, substantially, at a right angle, with respect to said support cradle and said first rod;
l. said first movable support and said second movable support being positioned on and being supported by said automobile;
m. said movable positioning means being rotatable in said support cradle;
n. said movable positioning means being supported by said support cradle;
o. said positioning means comprising a cylinder having a tapped passageway;
p. a threaded rod being in said tapped passageway;
q. said means to definitely position said suspension unit on said first rod being a clamping means;
r. said threaded rod being capable of moving in said tapped passageway to move said movable positioning means and said object; and,
s. said cylinder being rotatable in said support cradle.

7. A combination of an automobile having an object such as an engine and a transmission, and an appratus for supporting said object:
a. said apparatus comprising a first rod having a first end and a second end;
b. a first movable support positioned on said first rod;
c. a second movable support positioned on said first rod;
d. each of said supports having a leg;
e. said first rod and said movable supports being capable of moving with respect to each other;
f. a suspension unit;
g. said suspension unit connecting with said first rod;
h. a support cradle connecting with said suspension unit;
i. a movable positioning means connecting with said support cradle;
j. said movable positioning means being capable of connecting with said object;
k. said movable positioning means being capable of being moved, substantially, at a right angle, with respect to said support cradle and said first rod;
l. said first movable support and said second movable support being positioned on and being supported by said automobile;
m. said movable positioning means being rotatable in said support cradle;
n. a clamping means operatively connecting with said first arm;
o. a second rod;
p. said second rod operatively connecting with said clamping means; and,
q. a third movable support on said second rod.

8. A combination according to claim 7 and comprising:
r. said first rod and said second rod being at, substantially, a right angle.

9. A combination according to claim 8 and comprising:
r. said first rod having a plurality of first sides;
s. said first movable support having a plurality of second sides;
t. said first sides and said second sides being juxtapositioned, to have juxtapositioned sides, to guide the movement of said first rod and said first movable support with respect to each other;
u. said second movable support having a plurality of third sides;
v. said first sides and said third sides being juxtapositioned, to have juxtapositioned sides, to guide the movement of said first rod and said second movable support with respect to each other;
w. said second rod having a plurality of fourth sides;
x. said clamping means having a plurality of fifth sides;
y. said first sides and said fifth sides being juxtapositioned, to have juxtapositioned sides, to guide the movement of said first rod and said clamping means with respect to each other;
z. said clamping means having a plurality of sixth sides,
aa. said fourth side and said sixth sides being juxtapositioned, to have juxtapositioned sides, to guide the movement of said second rod and said clamping means with respect to each other;
bb. said third movable support having a plurality of seventh sides; and,
cc. said fourth side and said seventh sides being juxtapositioned, to have juxtapositioned sides, to guide the movement of said second rod and said third movable support with respect to each other.

10. A combination according ot claim 9 and comprising:
dd. the distance between said fifth sides being greater than the distance between said first sides to allow movement between said sides;
ee. the distance between said sixth sides being greater than the distance between said fourth sides to allow movement between said sides; and,
ff. the distance between said seventh sides being greater than the distance between said fourth sides to allow movement between said sides.

11. A combination of an automobile having an object such as an engine and a transmission, and an apparatus for supporting said object;
a. said apparatus comprising a first rod having a first end and a second end;
b. a first movable support positioned on said first rod;
c. a second movable support positioned on said first rod;
d. each of said supports having a leg;
e. said first rod and said movable supports being capable of moving with respect to each other;
f. a suspension unit;
g. said suspension unit connecting with said first rod;
h. a support cradle connecting with said suspension unit;
i. a movable positioning means connecting with said support cradle;
j. said movable positioining means being capable of connecting with said object;

k. said movable positioning means being capable of being moved, substantially, at a right angle, with respect to said support cradle and said first rod;
l. said first movable support and said second movable support being positioned on and being supported by said automobile;
m. said movable positioning means being rotatable in said support cradle;
n. a clamping means operatively connected with said first arm;
o. a second rod;
p. said second rod operatively connecting with said clamping means;
q. a third movable support on said second rod;
r. a second suspension unit on said second rod;
s. said suspension unit connecting with said second rod;
t. a second support cradle connecting with said suspension unit;
u. a second adjustable attaching means connecting with said second support cradle;
v. said second adjustable attaching means being capable of connecting with said object; and,
w. said second adjustable attaching means being capable of being moved with respect to said second support cradle and said second rod.

12. An apparatus for supporting an object, said apparatus comprising:
a. first tube having a first end and a second end;
b. said first tube in lateral cross-section being of a rectangular configuration;
c. a first movable support in lateral cross-section being a tube of a rectangular configuration;
d. the interior dimensions of said first moveable support being larger than the exterior dimensions of said first tube to allow said first moveable support to be positioned on said first tube;
e. said first moveable support being positioned on said first tube and being capable of moving with respect to said first tube;
f. a suspension unit comprising a tube in lateral cross-section being of a rectangular configuration and having interior dimensions larger than the exterior dimensions of said first tube to allow said first moveable support to be positioned on said first tube;
g. said suspension unit being positioned on said first tube and being capable of moving with respect to said first tube;
h. a support cradle connecting with said suspension unit;
i. an adjustable attaching means connecting with said support cradle;
j. said adjustable attaching means being capable of connecting with said object; and,
k. said adjustable attaching means being capable of being moved with respect to said support cradle and said first tube.

13. An apparatus according to claim 12 and comprising:
l. a second tube in lateral cross-section being of a rectangular configuration;
m. a clamping means comprising a third tube and a fourth tube;
n. said third tube and said fourth tube each being in lateral cross-section of a rectangular configuration;
o. said third tube and said fourth tube being integral;
p. the interior dimensions of said third tube and said fourth tube being larger than the exterior dimensions of said first tube and said second tube;
q. said first tube being in said third tube and being capable of moving relative to said third tube; and,
r. said second tube being in said fourth tube and being capable of moving relative to said fourth tube.

14. An apparatus according to claim 13 and comprising:
s. said third tube and said fourth tube being substantially at right angles to each other;
t. a second moveable support in lateral cross-section being a tube of a rectangular configuration;
u. the interior dimensions of said second moveable support being larger than the exterior dimensions of said first tube and also the exterior dimensions of said second tube; and,
v. said second moveable support can be positioned on said first tube or on said second tube and capable of moving on an appropriate one of said tubes.

15. A method for positioning an object such as an engine and a transmission, said method comprising:
a. positioning a first member above said object;
b. connecting to said first member and to said object a first connecting means;
c. manually actuating said first connecting means to position said object;
d. connecting a second member with said first member in a position above said object;
e. said first member and said second member being at, substantially, right angles;
f. connecting to said second member and to said object a second connecting means; and,
g. manually actuating said second connecting means to position said object.

16. A method for positioning an object such as an engine and a transmission in an automobile, said method comprising:
a. positioning a first member on said automobile and above said object;
b. connecting to said first member and to said object a first connecting means;
c. manually actuating said first connecting means to position said object;
d. positioning said first member transversely of the longitudinal axis of said automobile and to be adjacent to the fenders of said axis;
e. connecting a second member with said first member in a position above said object;
f. said first member and said second member being at, substantially, right angles;
g. connecting to said second member and to said object a second connecting means; and,
h. manually actuating said second connecting means to position said object.

17. A method for positioning an object such as an engine and a transmission in an automobile, said method comprising:
a. positioning a first member on said automobile and above said object;
b. connecting to said first member and to said object a first connecting means;
c. manually actuating said first connecting means to position said object;
d. positioning said first member substantially parallel to the longitudinal axis of said axis and to be adjacent to the front end of said axis and to be adjacent to the automobile near the windshield;

e. connecting a second member with said first member in a position above said object;
f. said first member and said second member being at, substantially right angles;
g. connecting to said second member and to said object a second connecting means; and,
h. manually actuating said second connecting means to position said object.

18. A method for using an apparatus for positioning an object such as an engine and a transmission in an automobile:

I. said apparatus comprising:
a. a first rod having a first end and a second end;
b. a first movable support positioned on said first rod;
c. a second movable support positioned on said first rod;
d. each of said supports having a leg;
e. said first rod and said movable supports being capable of moving with respect to each other;
f. a suspension unit;
g. said suspension unit connecting with said first rod;
h. a support cradle connecting with said suspension unit;
i. a movable positioning means connecting with said support cradle;
j. said movable positioning means being capable of connecting with said object;
k. said movable positioning means being capable of being moved, substantially, at a right angle with respect to said support cradle and said first rod;
l. said movable positioning means being rotatable in said support cradle;

II. said method comprising:
m. positioning said first rod on said automobile and above said object;
n. connecting said movable positioning means with said object;
o. positioning said first rod transversely of the longitudinal axis of said automobile and to be adjacent to the fenders of said automobile;
p. connecting a second member with said first member in a position above said object;
q. said first member and said second member being at, substantially right angles;
r. connecting to said second member and to said object a second connecting means; and,
s. manually actuating said second connecting means to position said object.

19. A method for using an apparatus for positioning an object such as an engine and a transmission in an automobile:

I. said apparatus comprising:
a. a first rod having a first end and a second end;
b. a first movable support positioned on said first rod;
c. a second movable support positioned on said first rod;
d. each of said supports having a leg;
e. said first rod and said movable supports being capable of moving with respect to each other;
f. a suspension unit;
g. said suspension unit connecting with said first rod;
h. a support cradle connecting with said suspension unit;
i. a movable positioning means connecting with said support cradle;
j. said movable positioning means being capable of connecting with said object;
k. said movable positioning means being capable of being moved, substantially, at a right angle with respect to said support cradle and said first rod;
l. said movable positioning means being rotatable in said support cradle;

II. said method comprising:
m. positioning said first rod on said automobile and above said object;
n. connecting said movable positioning means with said object;
o. positioning said first rod transversely of the longitudinal axis of said automobile and to be adjacent to the fenders of said automobile;
p. connecting a second member with said first member in position above said object;
q. said first member and said second member being at, substantially right angles;
r. connecting to said second member and to said object a second connecting means; and,
s. manually actuating said second connecting means to position said object.

20. A combination of an automobile having an object such as an engine and a transmission, and an apparatus for supporting said object:
a. said apparatus comprising a first rod having a first end and a second end;
b. a first movable support positioned on said first rod;
c. a second movable support positioned on said first rod;
d. each of said supports having a leg;
e. said first rod and said movable supports being capable of moving with respect to each other;
f. a suspension unit;
g. said suspension unit connecting with said first rod;
h. a support cradle connecting with said suspension unit;
i. a movable positioning means connecting with said support cradle;
j. said movable positioning means being capable of connecting with said object;
k. said movable positioning means being capable of being moved,
(k) substantially, at a right angle, with respect to said support cradle and said first rod;
l. said first movable support and said second movable support being positioned on and being supportped by said automobile;
m. said movable positioning means being rotatable in said support cradle;
n. said first rod having a plurality of first sides;
o. said first movable support having a plurality of second sides;
p. said first sides and said second sides being juxtapositioned, to have justapositioned sides, to guide the movement of said first rod and said first movable support with respect to each other;
q. said second movable support having a plurality of third sides;
r. said first sides and said third sides being juxtapositioned to have juxtapositioned sides, to guide the movement of said first rod and said second movable support with respect to each other;
s. the distance between said second sides being greater than the distance between said first sides; and,
t. the distance between said third sides being greater than the distance between said first sides to allow movement between said sides.

* * * * *